United States Patent [19]

Schweitzer

[11] Patent Number: 4,572,154

[45] Date of Patent: Feb. 25, 1986

[54] GAS RANGE

[75] Inventor: Ronald D. Schweitzer, Mansfield, Ohio

[73] Assignee: The Tappan Company, Mansfield, Ohio

[21] Appl. No.: 609,356

[22] Filed: May 11, 1984

[51] Int. Cl.[4] ..... F24C 3/00

[52] U.S. Cl. ..... 126/39 E; 126/37 B; 126/214 R

[58] Field of Search ..... 126/39 R, 39 B, 39 BA, 126/39 E, 214, 214 D, 39 H, 39 N, 38, 39 C, 39 K, 37 A, 37 B, 211, 214 R, 214 A, 214 C, 220

[56] References Cited

U.S. PATENT DOCUMENTS

| | | | |
|---|---|---|---|
| 2,649,850 | 8/1953 | Schlenk et al. | 126/214 A X |
| 2,655,912 | 10/1953 | Kennedy | 126/37 B |
| 3,455,290 | 7/1969 | Kemp | 126/39 |
| 3,645,249 | 2/1972 | Henderson et al. | 126/39 H |
| 3,809,055 | 5/1974 | Craver | 126/214 R X |
| 3,874,841 | 4/1975 | Ferlin | 126/39 E X |
| 4,261,327 | 4/1981 | Kamin | 126/215 |
| 4,409,954 | 10/1983 | Berlik et al. | 126/39 M |

FOREIGN PATENT DOCUMENTS

| | | | |
|---|---|---|---|
| 572005 | 5/1924 | France | 126/37 B |

*Primary Examiner*—Margaret A. Focarino
*Attorney, Agent, or Firm*—Alfred E. Miller

[57] ABSTRACT

In a gas range assembly, the gas burners are releasably held in the range top, gas being supplied to the burners by way of nozzles mounted in the burner box immediately below and spaced from the respective burners.

12 Claims, 8 Drawing Figures

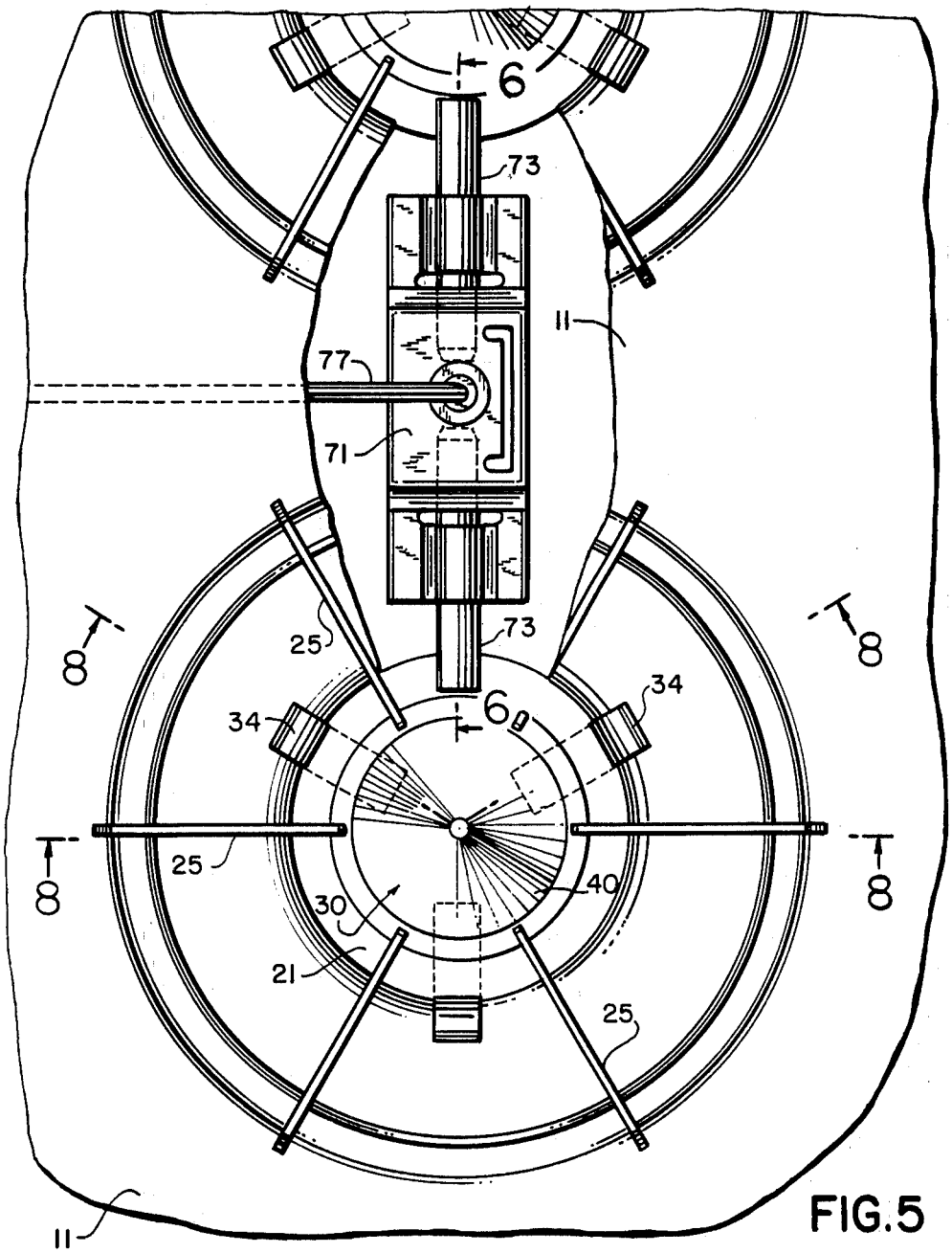
FIG.5
FIG.6
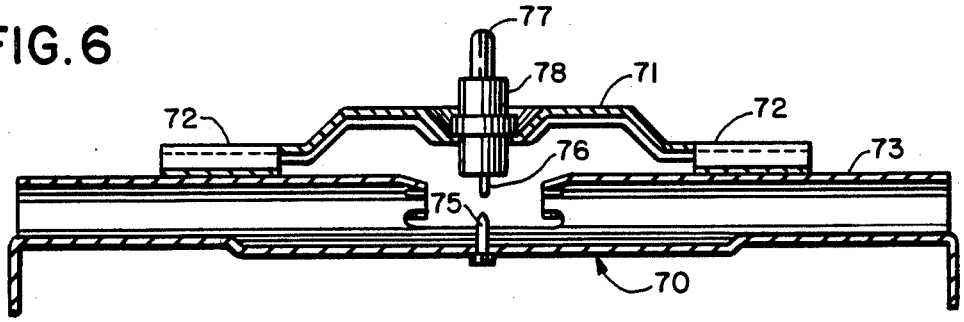

GAS RANGE

This invention relates to gas ranges, and more in particular to an improved top burner and range top assembly for gas ranges.

Conventional gas ranges are comprised generally of an apertured range top, with generally annular pans mounted in the apertures of the range top. Grates are mounted on the range top of the pans. The burners themselves are not physically supported by the range top or pans, but are affixed to the end of mixing tubes, the mixing tubes generally being held on mounting brackets on the underlying burner box. The mixing tubes generally incorporate primary air shutters, and are adapted to be removably affixed to the outputs of gas valves.

While such gas range assemblies function properly for example in cooking operations, the assembly of components raises a number of problems in manufacturing, use and appearance.

A major disadvantage of such arrangements is apparent in the well known procedure required for cleaning the range assembly. The burner box cannot be cleaned without separate removal of the mixing tube-burner assembly, and even then cleaning is rendered difficult by the permanently mounted brackets for holding the mixing tubes. The mixing tube-burner assemblies are also difficult to clean. The required reassembly of all of the components of the range, following cleaning, is also a tedious chore for non-mechanically inclined users of the range.

The requirement for providing removable mixing tubeburner assemblies, and their required mounting brackets, also increases the cost and difficulty of production of the range assemblies. Thus, the design of the mixing tubes must take into consideration the fact that they can readily be subject to damage by assembly, disassembly and cleaning by nonmechanically inclined persons. For this purpose it has been necessary to specifically overdesign the components so that they can withstand mechanical abuse. The required mounting brackets must of course be designed to enable the ready removal and reassembly of the mixing tube-burner assemblies.

A further design and production disadvantage arises in the fact that sufficient space must be provided between the bottom of the burners and the underlying burner box, in order to enable affixing of the curved mixing tubes to the bottom sides of their respective burners. This space requirement for the mixing tubes and their mounting brackets results in an undesirable overall increase in the height of the structure.

The assemblage of mixing tubes and burners, as well as their mounting brackets and the necessary ignition system, further results in a very cluttered unpleasant appearance which, although not readily apparent in use, is quite evident when the range top is lifted for cleaning or adjustment of the range.

The present invention is therefore directed to the provision of an improved range top assembly wherein the above disadvantages of known gas range assemblies is overcome.

Briefly stated, in accordance with the invention, the above objectives are achieved by providing a range assembly wherein the burners are supported solely by the range top, preferably from the edges of annular pans formed directly in the range top. The burners are held to the range top by spring clips, enabling their ready removal and replacement from the top sides of the range top.

Contrary to prior range assemblies, the mixing tubes are not affixed to the burners. Thus, the burners have an aperture in their lower sides. The function of the mixing tubes of prior range assemblies is now served by simple gas conveying tubing extending under the burner box, and having orificed ends extending to the bottom of the burner box. The orifices are in each case aligned with the apertures in the bottoms of the burners, without any physical interconnection between the orificed tubes and the burners. Accordingly, the space between the bottoms of the burners and the drip pans may be minimized, thereby reducing the overall height of the structure. Since removable mixing tubes are not employed, the drip pan is unencumbered by mounting brackets, its surface being interrupted substantially solely by the orifices extending a short distance above the bottom of the drip pan. Accordingly, the burner box may be readily cleaned without requiring extensive disassembly and assembly of components, and its fabrication is simplified by the absence of requirement of mounting brackets for mixing tubes.

The gas range assembly in accordance with the invention further provides a very pleasing appearance since, when the range top is lifted, the burner box region of the range is uncluttered by removable gas conveying devices.

In order that the invention will be more clearly understood it will now be disclosed in greater detail with reference to the accompanying drawings, wherein:

FIG. 5 is a top view, partially cut away, of a portion of a range assembly in accordance with the invention;

FIG. 6 is a cross sectional view of the ignition arrangement;

Figure 1:
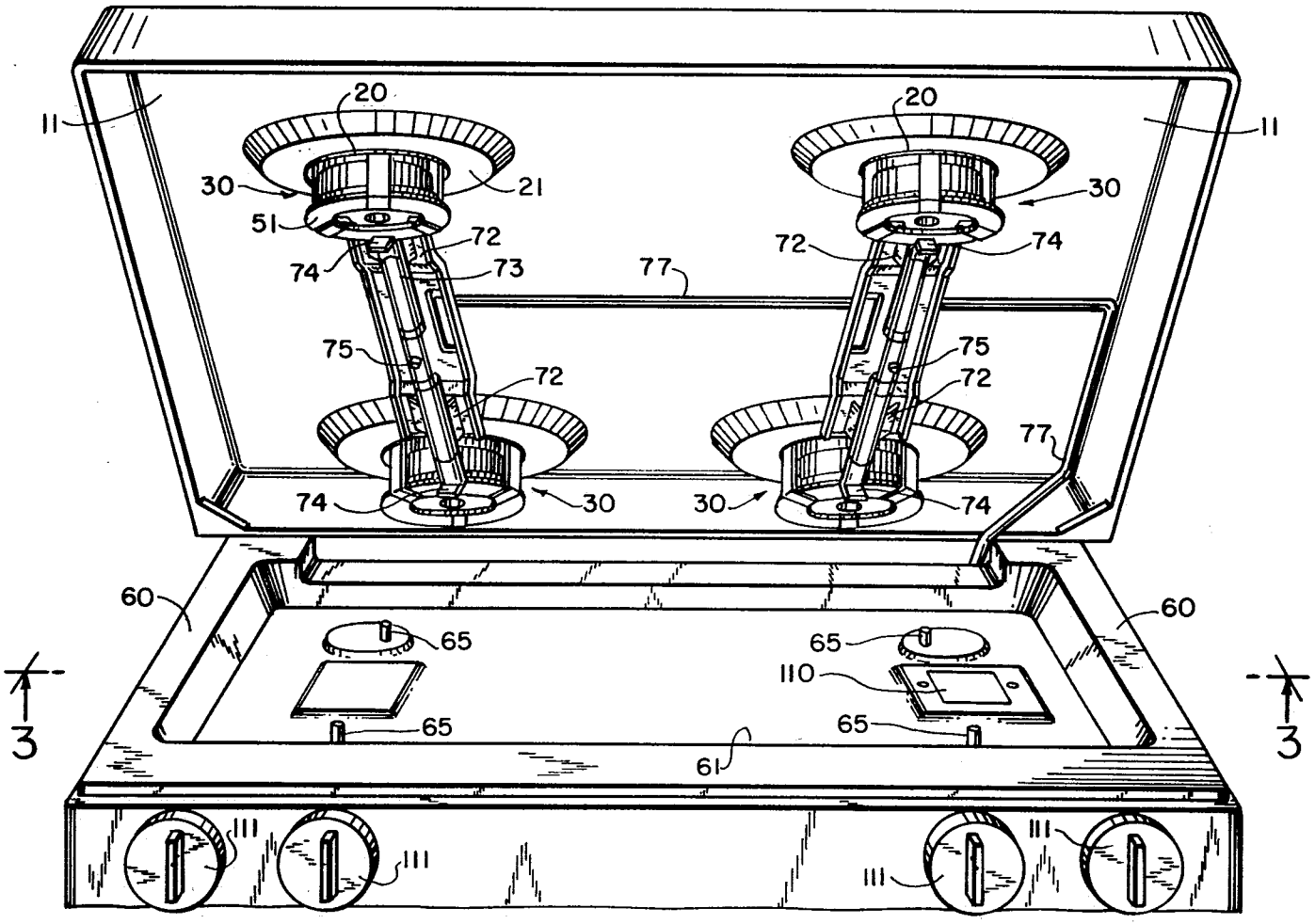
FIG. 1 is a perspective view illustrating the range top lifted to show the burners mounted to the underside of the range top, and the drip pan thereunder.
Figure 8:
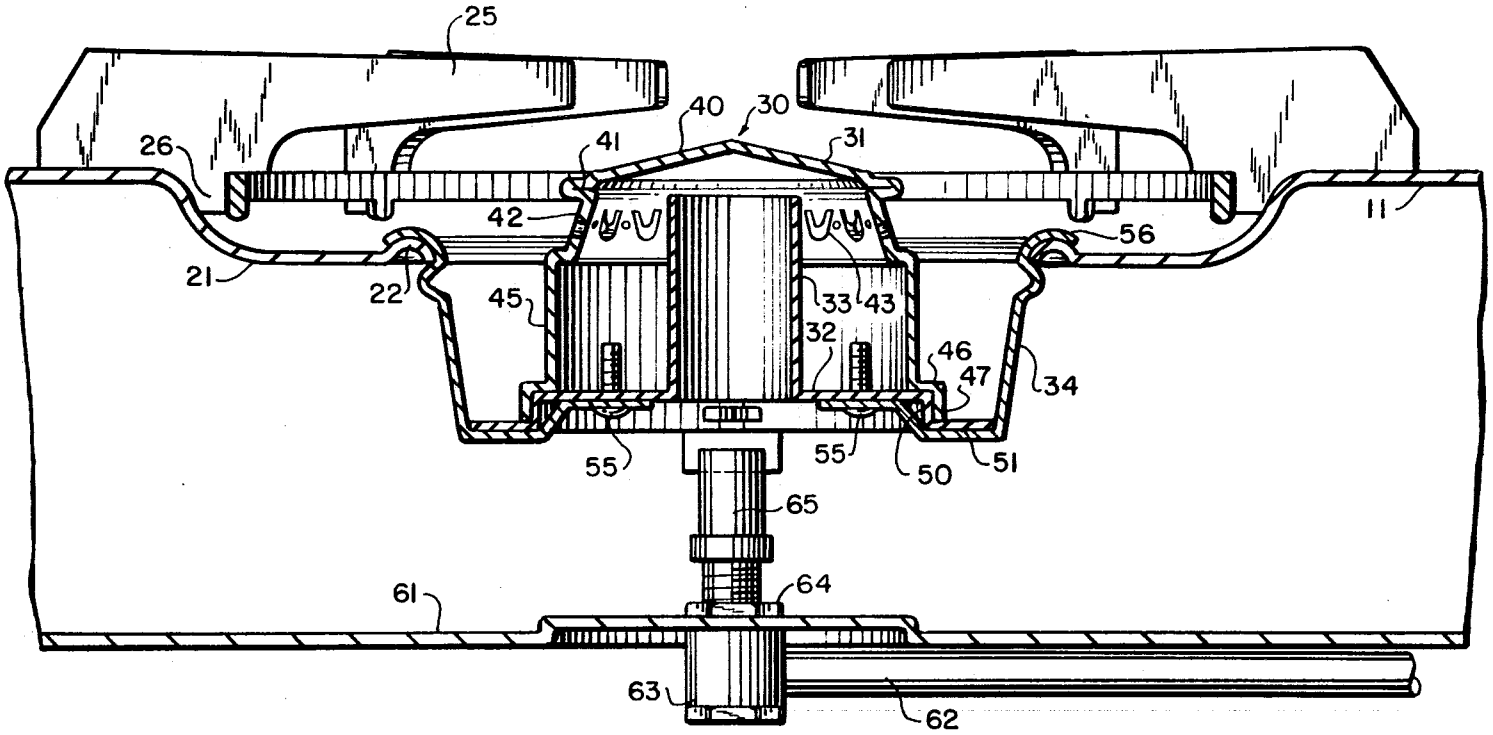
FIG. 8 is a cross sectional view of a portion of a range assembly in accordance with the invention.

Referring now to FIGS. 1 and 8 therein is illustrated a range in accordance with one embodiment of the invention, comprising range top 11 provided with one or more apertures 20, the range top preferably having an annular depression 21 surrounding each aperture 20. The inner edges of the depressions 21 are provided with an upwardly extending ridge (FIG. 8), preferably of arcuate section. It is to be especially noted that the depressions 21, and their respective annular ridges 22, are formed integrally with the range top 11, for example being stamped from the same sheet metal.

As seen in FIGS. 5 and 8, removable grate 25 is held in each of the depressions 21, for example having downwardly extending projections 26 uniformly spaced to engage the internal periphery of the recesses 21. The invention is not limited to the construction of the grate, nor to its manner of alignment on the range top.

Figure 2:
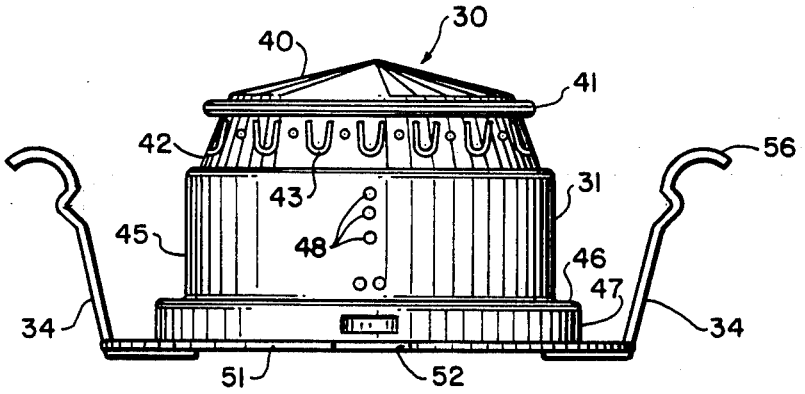
FIG. 2 is a side view of a burner.
Figure 7:
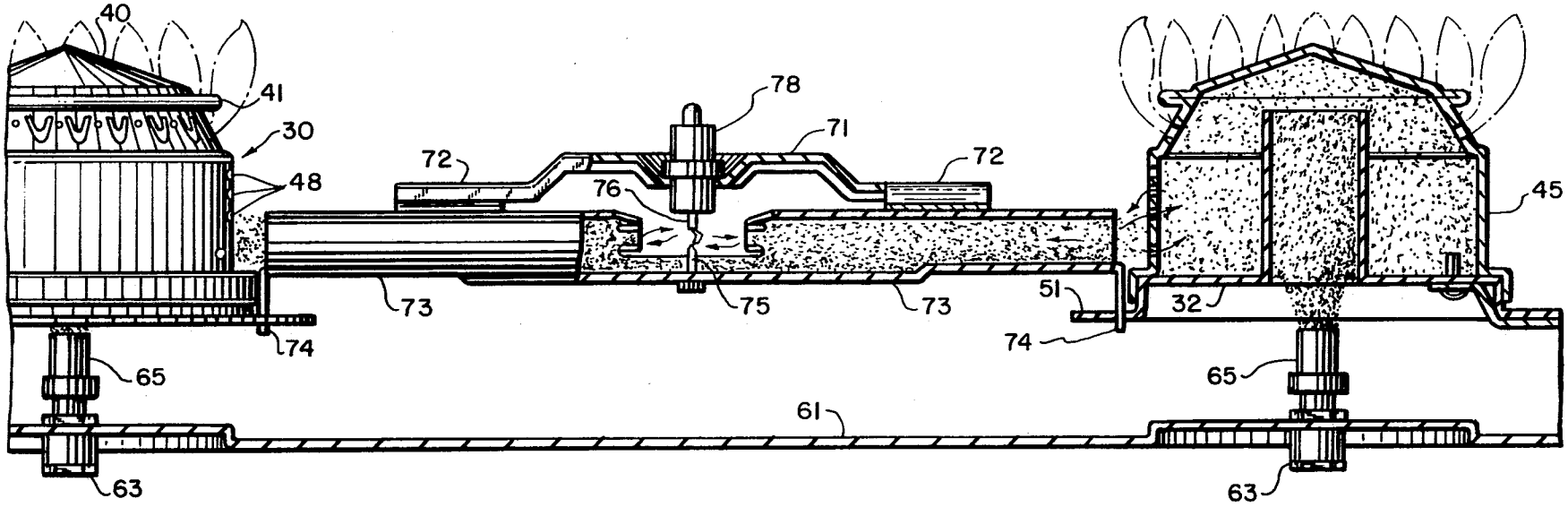
FIG. 7 is a partially cross sectional view showing the ignition of the range.

The burner 30 as more clearly seen in FIGS. 2, 7 and 8 is comprised of a burner top 31, preferably of round transverse cross section, which may be fabricated of aluminum. The burner is further comprised of a sheet metal annular baffle 32 fitted in the bottom of the burner top, and a burner tube 33, also of sheet metal, extending upwardly into the burner top from the aperture in the baffle 32. The burner is further comprised of preferably three spring clips 34 affixed to the underside of the baffle and extending upwardly to resiliently engage the annular ridge 22 of the depression 21, so as to enable snapping of the burner into position from the top of the range top, as well as removal therefrom.

The burner top 31 has a generally conical top 40, with upwardly extending apex, extending outwardly to an upper ridge 41. A frustoconical recess 42, with smaller diameter at its upper end, adjoins the ridge 41. A plurality of burner ports 43, for example of U-shaped cross section, extend through this frustoconical portion 42, equally distributed about its periphery. These ports direct the combustible gas to the flame.

A generally cylindrical portion 45 of the burner top extends downwardly from the frustoconical recess 42, and terminates at its bottom edge by an outwardly extending shoulder 46 and a downwardly extending annular rim 47 depending therefrom. The annular baffle 32 abuts the shoulder 46, and is held thereagainst by any suitable conventional means, such as deformation of the rim 47. A plurality of apertures 48 (FIG. 2) are provided extending through one side of the wall of the cylindrical portion 45, these apertures being aligned with an igniter assembly, as will be discussed in greater detail in the following paragraphs, to direct a flame to the region of the burner ports 43.

The baffle 32 has a downwardly extending outer shoulder 50 from which a radially outwardly extending edge 51 depends. The edge 51 has a notch 52 on the side thereof directed to the igniter assembly (not illustrated in FIG. 2), in order to enable the proper alignment of the apertures 48 of the burner with the igniter.

The spring clips 34, of which preferably three are provided, equally circumferentially distributed about the burner, are affixed to the underside of the baffle 32 by any convenient means, such as screws 55 as shown, or rivets or weldments. The spring clips extend around the periphery of the edge 51 of the baffle, and thence upwardly, having an upper edge 56 shaped to rest on the upper surface of the ridge 22, and preferably having a conforming shape. The spring clips 34 are preferably outwardly biased at their upper ends, and have notches 57 below their upper ends, adapted to engage the undersides of the edges of the ridges 22 to hold the burner in a fixed position, while enabling it to be readily snapped into position and removed therefrom.

Figure 4:
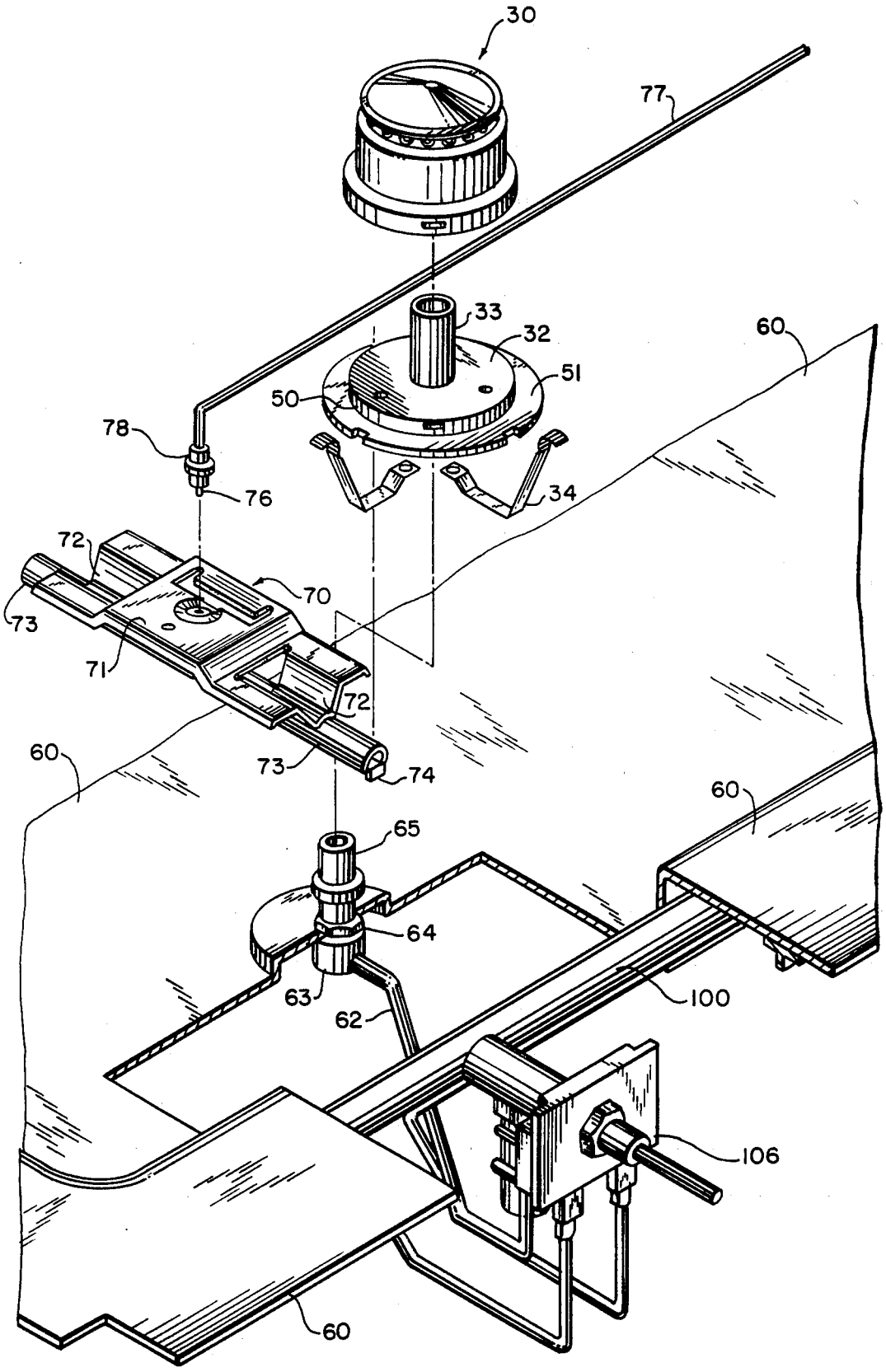
FIG. 4 is an exploded view of a portion of the assembly.

Referring to FIGS. 1, 4 and 8, a burner box 60 is fixedly mounted to the appliance structure, for example having an enlarged downwardly extending recess 61 extending beneath all of the burners in the appliance. The burner box 60 may be mounted by any conventional means (not illustrated). A gas tubing 62 extends directly from a gas valve 106, as seen in FIG. 4, to a fitting 63 affixed in an aperture in the burner box 60 aligned with the axis of the burner tube 33, the fitting 63 for example having a threaded upper end extending through the aperture in the burner box 60 and held therein by a nut 64. A nozzle 65 is provided on the end of the fitting 63 extending through the burner box, the nozzle 65 having an orifice for directing gas upwardly into the tube 33. The nozzle 65 may be, for example, of brass or stainless steel, although alternatively the orifice may be provided directly in the fitting 63. It will of course be apparent that other techniques of conventional nature may be employed for directing the gas flowing through tubing 62 upwardly through the bottom wall of the burner box into the burner tube 33.

It will be especially noted that the gas tubing 62 extends directly from the gas valve to the fitting 63, and that no air shutter, adjustable or not, is provided. In accordance with the invention it has been found that the provision of an air shutter is completely unnecessary. The orifice in the nozzle is dimensioned in order to provide the gas flow required to fall within the designed BTU rating of the burner. In other words, the gas orifice for any given application is dependent upon the output capacity of the burner.

It has been found that the space between the top of nozzle 65 and the bottom of the baffle 32 is not especially critical, dimensions of this distance from $\frac{3}{8}$ of an inch to 1 inch being found to be acceptable. It is desirable to increase the distance for better mixing, with dimensions under $\frac{3}{8}$ of an inch not enabling adequate supply of air. As the distance is increased, however, a "blow torch" effect arises. Accordingly, it has been found that a distance of approximately $\frac{1}{2}$ inch is preferred. This space requires no adjustment in use, thereby obviating the troublesome air adjustments that had been required in prior devices. It has been further found that adjustment is not required for adapting the range for different types of gases, such as natural gases, propane or butane, thereby further reducing the cost of producing the range.

It is further preferred that the distance from the top of the grate 25 to the ridge 41 at the top of the frustoconical burner top portion 42 be about 0.875 inches. This dimension has been found to maximize combustion, i.e., to minimize carbon monoxide production, by providing adequate combustion space, while still enabling efficient hearing.

The burner tube 33, which may be affixed to the baffle 32 by any conventional means such as flanging and spot welding, preferably has straight walls. While the tube may in principle extend below the baffle, such an arrangement may lead to a requirement of increasing the overall height of the range. In one embodiment of the invention the burner tube 33 had a diameter of 0.75 inches and a height of 1.25 inches, the height of the burner top from the bottom of the baffle to the top of the rim 41 being about 1.408 inches. In this example the diameter of the cylindrical portion 45 of the burner top was about 2.4 inches.

It has further been found that especially advantageous results occur when the top 40 of the burner top is conical, as illustrated. This feature has been found to direct the flames produced by burning of gas emitted from the ports 43, away from the ridge 22 adjacent thereto, to extend in a more upwardly direction. This prevents undesirable marking of the surface of the ridge 22 by burning, this edge for example being chrome plated. This desirable effect has been found to occur when the center of the top portion 40 of the burner top is from 0.2 to 0.4 inches above its edge.

Referring now to FIGS. 1, 4, 5, 6 and 7, therein is illustrated an ignition arrangement that may be employed, in accordance with the invention. As illustrated, a sheet metal assembly 70 is provided having a base 71 mechanically and electrically connected to the range top 11, for example by spot welding or the like. The base 71 is formed with a pair of inverted ridges 72 at opposite ends thereof, the ridges supporting a tube 73, the tube 73 being affixed for example by welding to the ridges 72. As is apparent in FIG. 1, the base 71 is formed so that the metal assembly can be fit between two burner locations, the ends of the base 71 conforming to the depressions 21 of an adjacent pair of burner locations. The tube 73 preferably extends along a line directly joining the axes of the two adjacent burners. The tube 73 has a length to extend substantially to the bottoms of the notches 52 of the baffles of the two burners, and slightly above the rim 51 of the baffles, so that the open ends of the tube 73 are in close proximity to the apertures 48 of the burners, and so that the burners cannot be snapped into the apertures of the range top unless the notches 52 thereof are fully aligned with the tube 73. The ends of the tube 73 may further be provided with downwardly extending lugs 74 having a sufficiently length to inhibit rotation of the burner when it is assembled in the range top.

The upper portion of the center of the tube 73 is open, whereby gas exiting through the apertures 48 of either of the burners may flow through the tube 73 to the open center thereof (as shown by the stippling and arrows in FIG. 7). A grounded electrode 75 is affixed to the center of the tube and extending into the open center portion thereof. An insulated electrode 76 connected to insulated wire 77 is positioned spaced from the grounded electrode 75, so that upon the application of a high voltage to the electrode 76, a spark will be caused to jump between the electrode and the grounded electrode 75, thereby to ignite the gas. The end of the wire 77 to which the electrode 76 is connected may be held in a shaped insulated element 78 adapted to be shapped or otherwise held in a suitable aperture or slot in the base 71. The wire 77 is connected to a conventional source of ignition voltage (not illustrated).

Figure 3:
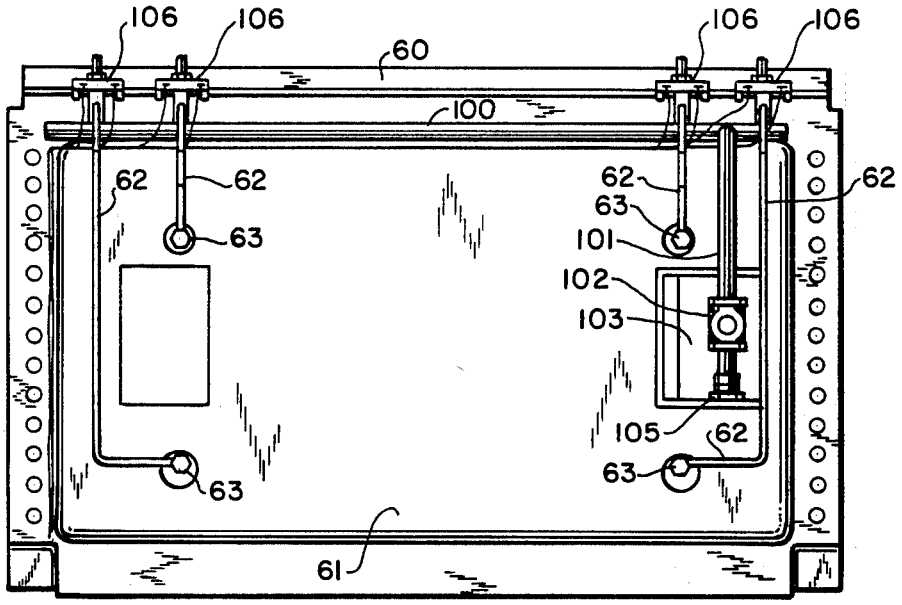
FIG. 3 is a bottom view of the range assembly.

As illustrated in FIG. 3, showing the underside of the burner box, the gas manifold 100 extends along the front of the burner box 60, just in front of the recessed portion 61 thereof. The feed pipe 101 for the manifold extends downwardly from the manifold and rearwardly under the burner box, to a flow valve 102 positioned under a cutout 103 in the bottom of the drip pan. This cutout, which is covered by a suitable plate in use (not shown in FIG. 3), enables adjustment of the valve, for example, for the type and pressure of gas to be employed in the range. A union 105 connected to the inlet port of the valve 102 enables a hard pipe hookup for the range, as required by some codes.

The arrangement of the manifold in this manner removes it from the interior of the burner box, with the consequent advantages in design requirements and cleaning. The gas valves 106, of conventional type, are affixed directly to the manifold 100, extending forwardly thereof. The outlets of the gas valves 106 are connected directly to the tubes 62 for conveying gas to the respective burners.

The valves are of course each connected to a conventional ignition voltage generator (not shown) for generating the voltage to be applied to the ignition wire 77.

FIG. 1 illustrates a range in accordance with the invention, wherein the range top 11, hinged at its rear by suitable conventional means, has been raised for example for cleaning. The depressed portion 61 of the burner box is uncluttered, merely displaying the nozzle 65 extending upwardly through its bottom, and a service removable plate 110 enabling access at the top to the flow valve 102 and union 105 of FIG. 3. This access to the union 105 facilitates installation of the range.

The ignition wires 77 may be guided by conventional means on the underside of the range top to the region of the rear hinge thereof, for connection to the high voltage generator (not illustrated), the generator also being connected by conventional means to the valves 106 illustrated in FIG. 3. The control knobs 111 in FIG. 1 enable manual control of the valves 106.

In order to clean the gas range assembly in accordance with the invention, it is only necessary to remove the grates 25 by lifting them upwardly from the top of the range top, and then snapping the burners 30 from their respective burner positions. These elements may be separately cleaned. It is not necessary to remove any components from the burner box, and the entire area under the range top 11 may hence be cleaned merely by lifting the range top as illustrated in FIG. 1. Reassembly of the elements following cleaning is simply effected in the reverse order, by snapping the burners in position at the burner positions, and replacing the grates.

It is of course apparent that the gas range of the invention may be employed either as a separate appliance, or in combination with other appliances, such as an oven mounted thereunder.

While the invention has been disclosed and described with reference to a single embodiment, it is apparent that variations and modifications may be made therein. Thus, in various modifications of the invention the burners, range top, grates and burner box, for example only, may have different shapes than described and illustrated. It is therefore intended in the following claims to cover each such variation and modification as falls within the true spirit and scope of the invention.

What is claimed is:

1. A gas range having a range top with at least one aperture, a burner, means for separately releasably holding said burner to said range top in said aperture and defining the sole support of said burner, a burner box beneath said burner, said burner having an aperture on the underside thereof for receiving gas to be burnt, and a gas orifice mounted in said burner box below said burner and spaced vertically directly below the aperture of said burner without air shutter means therebetween, for directing gas into said aperture and gas supply tubing means located solely outside of said burner box and connecting means for connecting said gas supply tubing means to said gas orifice means outside of said burner box.

2. The range of claim 1 wherein said burner is comprised of a burner top having a closed upper end and a generally round transverse cross section, with gas outlet ports extending through the side walls thereof adjacent the top of said burner top, a baffle affixed to the lower end of said burner top and having an aperture coaxial with said burner top, and a tube affixed to said baffle and extending upwardly from said aperture of said baffle into said burner top, whereby the aperture of said baffle defines said aperture for receiving gas and is spaced directly above said orifice.

3. The range of claim 1 wherein said means for holding said burner comprises spring clip means affixed to said burner and extending to resiliently engage said range top adjacent said aperture, whereby said burner is supported solely by said spring clips.

4. The gas range of claim 1 wherein the said gas orifice is spaced from said aperture of said burner from ⅜ inch to 1 inch.

5. A gas range assembly comprising a burner box, a range top mounted above said burner box and having at least one aperture, a burner releasably held in said aperture of said range top and having an aperture at its lower side for receiving gas, said range top defining the sole support of said burner, and an orifice mounted in said burner box aligned with the gas receiving aperture of said burner and spaced therefrom for directing gas into said gas receiving aperture, the space between said orifice and gas receiving aperture being free and without any air shutter means and gas supply tubing means located solely outside of said burner box and connecting means for connecting said gas supply tubing means to said orifice means outside of said burner box.

6. The gas range of claim 5 further comprising means for hingedly mounting said range top with respect to said burner box, whereby said range top may be lifted to enable access to said burner box with said burner being hinged away from said burner box and said orifice remaining in said burner box.

7. The gas range of claim 6 further comprising a gas manifold mounted under said burner box, a gas valve connected to said manifold, said tubing means extending under said burner box and connecting said gas valve to said nozzle, whereby said burner box is free of gas flow directing elements except at least one said orifice when said range top is hinged away from said burner box.

8. The gas range of claim 5 wherein said space between said orifice and gas receiving aperture is from $\frac{3}{8}$ inch to 1 inch.

9. In a gas range assembly including a burner box, a range top having an aperture, a burner having a gas inlet port, means mounting said burner to be positioned in alignment with said aperture, and means directing gas to said burner port; the improvement wherein said means mounting said burner comprises means supporting said burner solely from said range top, said port comprising an aperture in the bottom of said burner, and said means directing gas comprises an orifice mounted in said burner box and aligned with said aperture of said burner, said orifice being sapced from said aperture of said burner without any air shutter therebetween and gas supply tubing means located solely outside of said burner box and connecting means for connecting said gas supply tubing means to said gas orifice means outside of said burner box.

10. The gas range assembly of claim 9 further comprising hinge means coupled to said range top to permit said range top to be hinged away from said burner box, whereby said orifice remains in said burner box and said burner is hinged away from said burner box when said range top is hinged away from said burner top.

11. The gas range assembly of claim 10 wherein said orifice is spaced from said aperture of said burner a distance of $\frac{3}{8}$ inch to 1 inch when said range top is not hinged away from said burner box.

12. The gas range assembly of claim 9 further comprising a gas valve said tubing means directing gas from said gas valve directly to said orifice beneath said burner box, whereby no air shutter is provided between said valve and aperture of said burner.

* * * * *